United States Patent [19]

Norris et al.

[11] Patent Number: 4,644,098

[45] Date of Patent: Feb. 17, 1987

[54] LONGITUDINALLY WRAPPED CABLE

[75] Inventors: Daniel A. Norris, Dallas, Ga.; James O. Lowery, Ranburne, Ala.; Robert F. Armstrong, Marietta, Ga.

[73] Assignee: Southwire Company, Carrollton, Ga.

[21] Appl. No.: 692,592

[22] Filed: Jan. 18, 1985

Related U.S. Application Data

[63] Continuation of Ser. No. 151,506, May 19, 1980, abandoned.

[51] Int. Cl.[4] ..... H01B 7/02

[52] U.S. Cl. ..... 174/115; 174/113 R; 174/116; 174/122 R

[58] Field of Search ..... 174/113 R, 115, 116, 174/121, 122 R

[56] References Cited

U.S. PATENT DOCUMENTS

| | | | |
|---|---|---|---|
| Re. 30,228 | 3/1980 | Silver | 174/102 SC |
| 1,116,090 | 11/1914 | May | 174/122 A X |
| 1,739,012 | 12/1929 | Middleton | 174/116 |
| 1,746,390 | 2/1930 | Frederickson | 174/116 |
| 2,281,111 | 4/1942 | Robinson | 174/116 |
| 2,900,437 | 8/1959 | Thompson | 174/116 |
| 3,649,744 | 3/1972 | Coleman | 174/113 R |
| 3,745,231 | 7/1973 | Eager | 174/116 X |
| 3,843,829 | 10/1974 | Bridges | 174/36 |
| 4,229,615 | 10/1980 | Orr | 174/116 X |
| 4,252,584 | 2/1981 | Garner | 156/54 |

FOREIGN PATENT DOCUMENTS

| | | | |
|---|---|---|---|
| 1387991 | 3/1975 | United Kingdom | 174/102 SP |

*Primary Examiner*—R. R. Kucia

*Attorney, Agent, or Firm*—Stanley L. Tate; Herbert M. Hanegan

[57] ABSTRACT

Disclosed is an electric service entrance cable comprising parallel insulated conductors, helically covered by evenly distributed uninsulated conductors, covered by longitudinally wrapped polyester glassed-backed reinforcement tape bound by helically wrapped fiberglass strand and an outer covering.

11 Claims, 4 Drawing Figures

LONGITUDINALLY WRAPPED CABLE

This is a continuation of application Ser. No. 151,506 filed on May 19, 1980 now abandoned.

BACKGROUND OF THE INVENTION

The present invention relates generally to cable making and specifically to an electric service entrance cable.

Electric service entrance cable meeting the requirements of Underwriters Labratories Inc. Standard For Service-Entrance Cables UL 854 is normally constructed of parallel insulated conductors, helically covered by evenly distributed uninsulated conductors, helically covered by reinforcement tape and finally, covered by an outer jacket. One example of such service entrance cable is disclosed in U.S. Pat. No. 3,586,751.

Electric service entrance cable with a helical layer of reinforcement wrapping tape is well known in the prior art. United Kingdom Pat. No. 921,453 illustrates helical wrapping of an electric cable, and U.S. Pat. No. 3,631,662 illustrates an apparatus for helically winding binding strap.

SUMMARY OF THE INVENTION

The present invention is an improved electric service entrance cable wherein the reinforcement tape is longitudinally applied, and is bound by a helically wrapped binder strand. Longitudinal application greatly increases productivity because much higher operating speeds can be reached since the wind drag involved in revolving wide tape about the cable is substantially eliminated. In addition, due to spiral application, a percent of tape is lost with every revolution of tape about the cable. Another advantage with longitudinal application is a constant lap in tape running the length of the cable. In spiral application, the length of tape used in length of cable plus circumferences of tape lays contained in that length. Expressed mathematically:

Spiral $T$=Tape used per 1000′ of cable $l$=Length of cable $L_T$=Lay of tape (in feet)

$C$=Cable circumference $T_S=l+(l/L_T)C$

Longitudinal $T_L=l$

Thereby, the factor $(l/L_t)C$, representing the loss tape due to spiral application, is eliminated. Since $L_T$ and $C$ vary with cable size, each product has a different $T_S$. A percent savings directly proportional of $T_S/T_L$ can be computed, thus giving the following % yield increases.

| Major SEU Products | Tape Width | % Yield Increase (Spiral to Longitudinal) |
|---|---|---|
| 8-3 | 2.00 in. | 16.4 |
| 6-3 | 2.25 | 11.9 |
| 4-3 | 2.50 | 8.0 |
| 2-3 | 2.75 | 18.6 |
| 4/0-3 | 4.00 | 25.1 |
| 4-4-6 | 2.50 | 8.0 |
| 2-2-4 | 2.75 | 18.6 |
| 4/0/4/0-2/0 | 4.00 | 23.3 |

In actual application of longitudinal wrap SEU one must consider tape widths used and tape laps as a result of tap widths. In calculating savings, in percent, both tape widths and tape lap must be considered. In general, savings is computed with a tape lap of ½″ rather than the ¼″ lap specification by U.L. There are two advantageous effects of this. First, an allowance is built-in for oversize cable which occurs from time to time. Second, by extending the average lap to ½″, there is a significant reduction in tape width needs. Materials handling is greatly improved by reduction.

Since the cable is a twin conductor cable, the overall crossectional shape is basically an ellipse with a major axis approximately twice the size of the minor axis. As this ellipse-shaped cable advances along the processing path, the cable frequently twists, that is the major axis of the ellipse rotates from a usual horizonttal orientation through a vertical orientation and back to a horizontal orientation. This type of fluctuation and fluctions caused by cable irregularities and cable splices have been a major problem in prior art tape folder, leading to processing line jams, cable breakage and tape folder destruction. The present invention solves these problems because the tape folder is constructed of multiple rings which apply the tape to the cable by adapting the tape to the orientation of the cable instead of adapting the cable orientation to the tape folder.

Thus a major object of the present invention is to provide an electric service entrance cable comprising a longitudinally wrapped reinforcement tape bound by helically wrapped binder strand.

Another object of this invention is to increase electric service entrance cable manufacturing productivity by increasing processing speed and by decreasing amounts of reinforcement tape required.

Still another object of the present invention is to provide ability to process slightly oversize cable while still meeting ¼ inch overlap requirements by running a standard ½ inch overlap.

BRIEF DESCRIPTION OF THE DRAWING

While the specification concludes with claims particularly pointing out and distinctly claiming the subject matter which is regarded as the invention, it is believed that the invention, objects, features and advantages thereof will be better understood from the following description taken in connection with accompanied drawings in which like parts are given like identification numerals and wherein:

DESCRIPTION OF THE PREFERRED EMBODIMENT

This invention is an improved electric service entrance cable.

Figure 2:
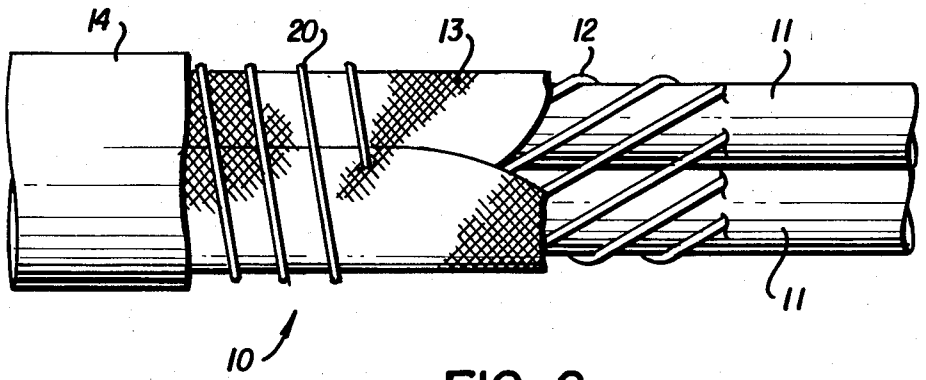
FIG. 2 is an overhead view of the electric service entrance cable of FIG. 1 illustrating cable of several processing steps.
Figure 1:
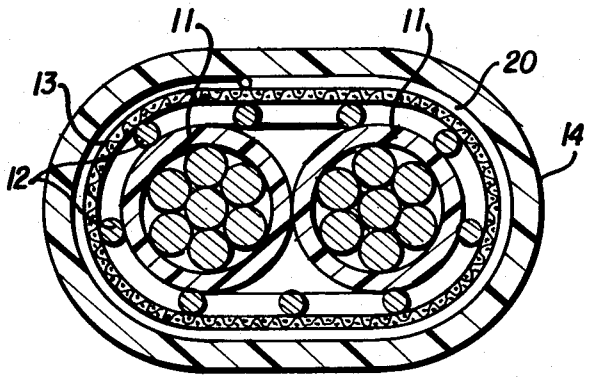
FIG. 1 is a crossectional end view of electric service entrance cable of the present invention.

As FIG. 1 illustrates, the improved service entrance cable 10 comprises a pair of parallel insulated conductors 11 wrapped by a multiplicity of evenly distributed uninsulalted conductors 12 covered by a layer of reinforcement tape 13 and an outer insulation jacket 14. FIG. 2 shows in more detail how the cable 10 is constructed. As the parallel insulated conductors 11 advance along a processing path, a multiplicity of evenly spaced uninsulated or neutral conductors 12 are helically wrapped around the pair of insulated conductors 11. The cable 10 is then longitudinally wrapped by a layer of reinforcing tape 13 which overlaps from about ¼ inch to ½ inch. Immediately after the tape 13 is applied, a binder strand 20 is helically wrapped over the tape 13 to bind the tape 13. The cable 10 then continues along a processing path for application of an outer insulation jacket 14.

The reinforcing tape 13 is a polyester glassed-backed tape, preferrably polyethylene terephthalate bonded to woven fiberglass. The polyester film should be within the range of from about 0.0005 inch to about 0.0015 inch thick. The woven fiberglass should have a warp of approximately 150-1/0 at 20 ends per inch and a woof of approximately 75-1/0 at 10 ends per inch.

Preferred examples of tape construction are:

0.0005 inch polyester laminated to woven fiberglass with warp of 150-1/0 at 20 ends per inch and woof of 75-1/0 at 10 ends per inch;

0.5 mil thick polyester film backed tape with bidirectionally lain glass reinforcing threads widthwise at 20 threads per inch and lengthwise at 10 threads per inch;

0.001 inch polyester laminated to woven fiberglass with warp of 150-1/0 at 20 ends per inch and woof of 75-1/0 at ten ends per inch;

0.00142 polyester laminated to woven fiberglass with warp of 150-1/0 at 20 ends per inch and woof 75-1/0 at 10 ends per inch;

woven fiberglass with warp of 150-1/0 at 20 ends per inch and woof of 75-1/0 at ten ends per inch bonded to 0.0005 inch thick polethylene terephthalate; and woven fiberglass with warp of 150-1/0 at 20 ends per inch and woof of 75-1/10 at ten ends per inch bonded to 0.001 inch thick polyethylene terephthalate.

The binder strand 20 should be constructed of 200 to 1000 denier fiberglass for high strength. Advantageously said strand is constructed of an aramid fiber with a yield of at least 30,000 ft. lbs., 12 lb. minimum breaking strength at 500° F.; and should have a maximum lay of approximately 3.5 inches. Preferably the binder strand fiber has a yield of at least 33,000 ft. lbs. and a minimum breaking strength of 14 lb. and may be a fiber such as Kevlar, a trademarked product of Du-Pont.

Figure 3:
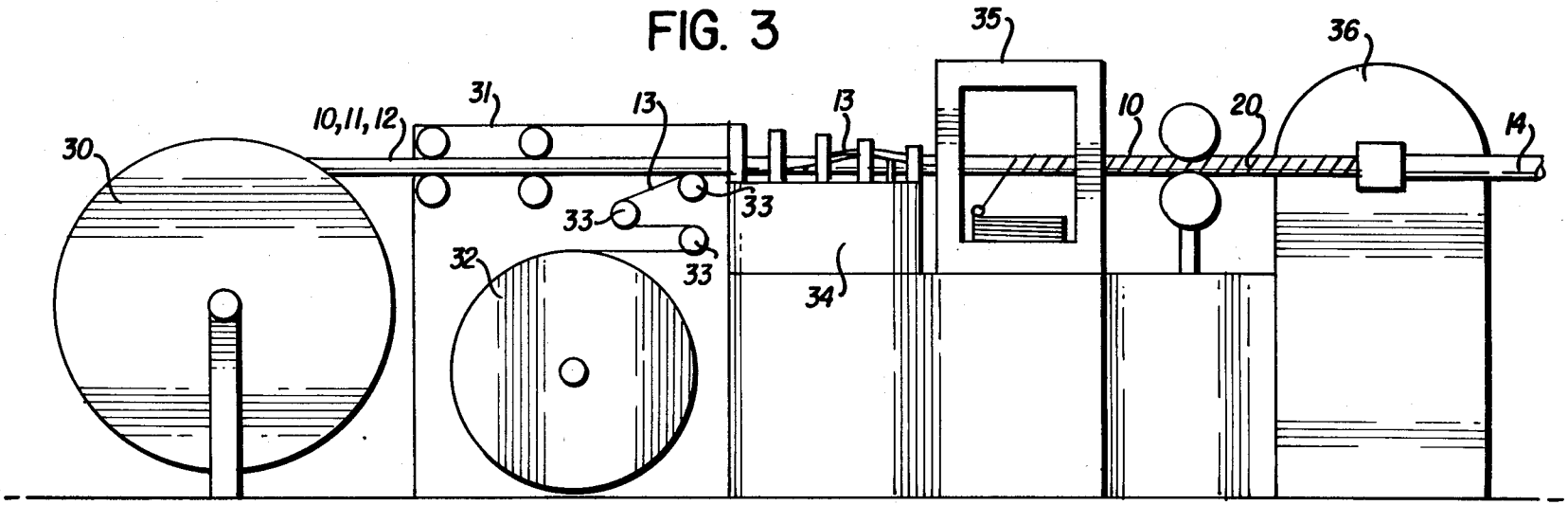
FIG. 3 is a side view of the apparatus of the present invention.

FIG. 3 is an overall side view of the apparatus of the present invention. Cable 10, comprising a pair of insulated conductors 11 helically wrapped by a multiplicity of uninsulated conductors 12 at this stage of processing, is directed from a cable supply spool 30 into a predetermined processing path by cable alignment means 31. Tape 13 is guided from a tape supply spool 32 into a predetermined processing path by tape rollers 33. As the cable 10 and the tape 13 advance, the tape 13 is longitudinally applied over the cable 10 by a tape folder 34. The binder strand 20 is then helically wrapped over the tape 13 by a helicaal wrapping mechanism 35, and the cable 10 advances through an extruder 36 which applies an outer insulation jacket 14.

Figure 4:
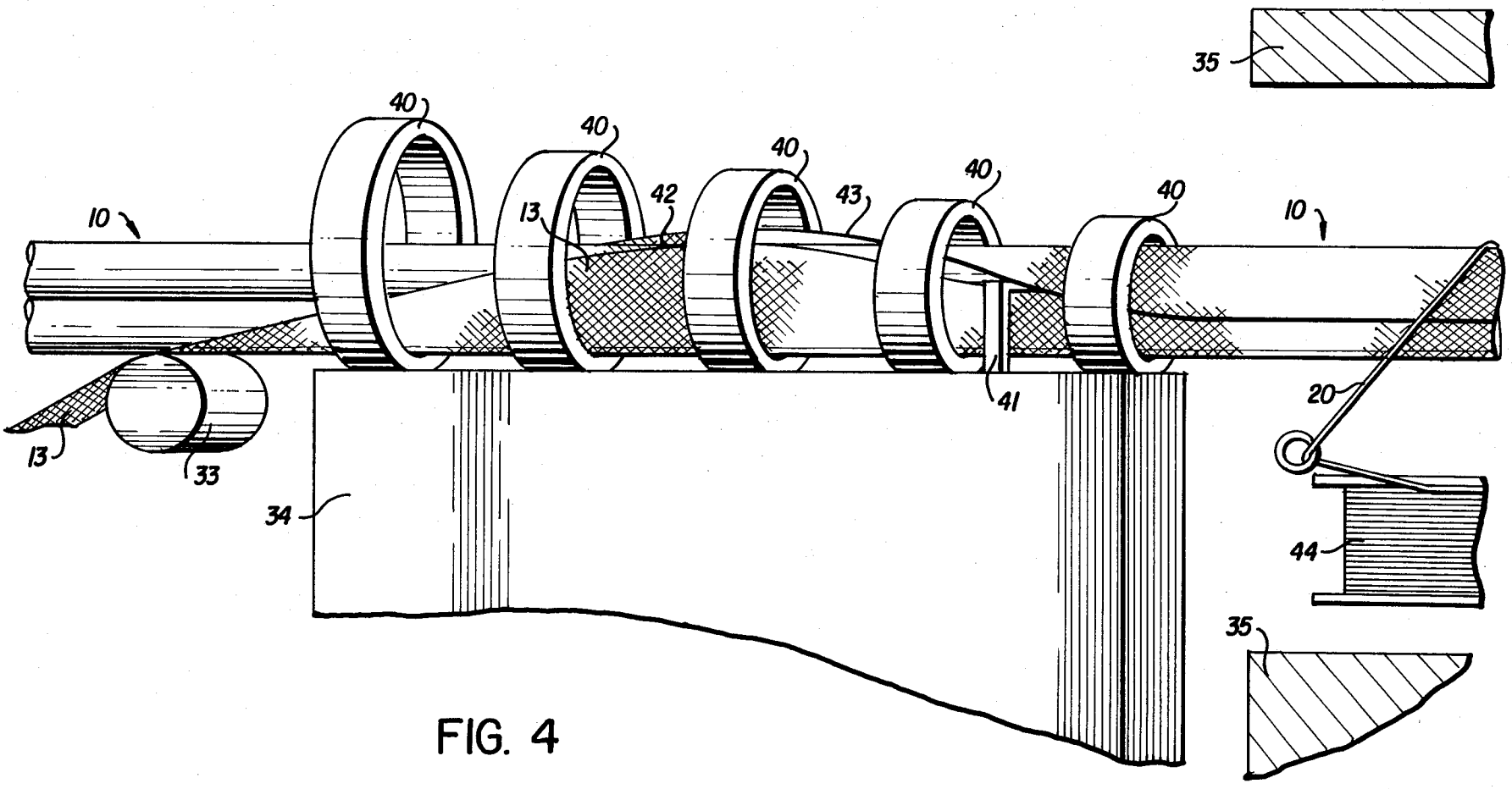
FIG. 4 is another view of the apparatus of the present invention showing operation of portions of the present invention in more detail.

FIG. 4 illustrates some components of the means for longitudinally applying the overlapping tape 13 over the cable 10, and the means for helically wrapping the binder strand 20 over the tape 13 to bind the tape 13. The cable 10 and the tape 13 meet at the entrance of the tape folder 34. The tape folder 34 comprises a multiplicity of tape guide rings 40 and a tape edge separator 41. The rings 40 direct the first longitudinal edge 42 of the tape 13 in an arcuate path about the cable 10 until the first longitudinal edge 42 and portions of the tape 13 adjacent thereto contact the outer surface of the cable 10. The rings 40 also direct the second longitudinal edge 43 of the tape 13 in a retarded reciprocal arcuate path about the cable 10 until the second longitudinal edge 43 and portions of the tape 13 adjacent thereto contact outer surfaces of the cable 10 and the first longitudinal edge 42 into overlapping relationship with the first longitudinal edge 42. The tape edge separator 41 assists the rings 40 in maintaining the tape edges 42 and 43 in their correct arcuate paths while assuring the direction of overlap remains constant.

In addition, due to multiple ring 40 construction, the tape folder 34 solves prior art cable orientation problems caused by cable twists, cable splices and other irregularities by adapting the tape 13 to the cable 10 regardless of the changes in the orientation of the cable 10.

Immediately upon completion of longitudinal wrapping of the tape 13, the binder strand 20 is helically wrapped around the cable 10 in the same direction as the overlapping edge 43 of the tape 13 by the helical wrapping mechanism 35 to assumre proper binding of said overlapping edge 43. The helical wrapping mechanism 35 comprises binder strand supply means 44, means (not shown) for rotating the binder strand supply means 44 around the cable 10 in a plane perpendicular to the predetermined cable path as the cable 10 advances, and means (not shown) for regulating the speed of the rotating means (not shown) relative to the advancing speed of the cable 10 so that the binder strand 20 has maximum lay of approximately 3.5 inches.

While this invention has been described in detail with particular reference to a preferred embodiment thereof, it will be understood that variations and modifications can be effective within the spirit and scope of the invention as described hereinbefore and as defined in the following claims.

What is claimed is:

1. An improved electric service entrance cable of the type conforming to the requirements of the Standard For Service-Entrance Cable UL854 and having parallel insulated conductors helically wrapped by a multiplicity of evenly distributed uninsulated conductors and covered by a layer of tape and an outer jacket the improvement comprising:

an overlapping layer of reinforcing tape longitudinally applied over said uninsulated conductors;

a high strength binder strand a fiberglass helically wrapped over said layer of tape to bind said tape;

wherein said longitudinally applied layer of tape overlaps from approximately one quarter of an inch to approximately one half of an inch;

wherein said longitudinally applied layer of tape is adapted to the orientation of said insulated and uninsulalted conductors regardless of changes in said orientation; and wherein said longitudinally applied tape is a glass-backed polyester tape.

2. The electric service entrance cable of claim 1 wherein said longitudinally applied tape is constructed of 0.0005 inch polyester laminated to woven fiberglass with warp of 150-1/0 at 20 ends per inch and woof of 75-1/0 at 10 ends per inch.

3. The electric service entrance cable of claim 1 wherein said longitudinally applied tape is constructed of 0.5 mil thick polyester film backed tape with bidirectionally lain glass reinforcing threads widthwise at 20 threads per inch and lengthwise at 10 threads per inch.

4. The electric service entrance cable of claim 1 wherein said longitudinally applied tape is constructed of 0.001 inch polyester laminated to woven fiberglass with warp of 150-1/0 at 20 ends per inch and woof of 75-1/0 at ten ends per inch.

5. The electric service entrance cable of claim 1 wherein said longitudinally applied tape is constructed of 0.00142 polyester laminated to woven fiberglass with warp of 150-1/0 at 20 ends per inch and woof of 75-1/0 at 10 ends per inch.

6. The electric service entrance cable of claim 1 wherein said longitudinally applied tape is constructed of woven fiberglass with warp of 150-1/0 at 20 ends per inch and woof of 75-1/0 at ten ends per inch bonded to 0.0005 inch thick polethylene terephthalate.

7. The electric service entrance cable of claim 1 wherein said longitudinally applied tape is constructed of woven fiberglass with warp of 150-1/0 at 20 ends per inch and woof of 75-1/10 at ten ends per inch bonded to 0.001 inch thick polyethylene terephthalate.

8. The electric service entrance cable of claim 1 wherein said helically wrapped binder strand has maximum lay of approximately 3.5 inches.

9. The electric service entrance cable of claim 1 wherein said helically wrapped binder strand is constructed of 200 to 1000 denier aramid fiber with a yield of at least 30,000 ft. lbs., 12 lb. minimum breaking strength, and property retention at 500° F.

10. The electric service entrance cable of claim 1 wherein said helically wrapped binder strand is constructed of 200 to 1000 denier aramid fiber with a yield of at least 33,000 ft. lbs., 14 lb. minimum breaking strength, and property retention at 500° F.

11. The electric service entrance cable of claim 1 wherein said helically wrapped binder strand is constructed of 400 denier aramid fiber.

* * * * *